US008288736B2

(12) United States Patent
Amelia et al.

(10) Patent No.: US 8,288,736 B2
(45) Date of Patent: Oct. 16, 2012

(54) TARGET DEVICE FOR PRODUCING A RADIOISOTOPE

(75) Inventors: Jean-Claude Amelia, Erquelinnes (BE); Michel Ghyoot, Louvain-la-Neuve (BE)

(73) Assignee: Ion Beam Applications SA, Louvain-le-Neuve (BE)

( * ) Notice: Subject to any disclaimer, the term of this patent is extended or adjusted under 35 U.S.C. 154(b) by 274 days.

(21) Appl. No.: 10/597,974

(22) PCT Filed: Feb. 18, 2005

(86) PCT No.: PCT/BE2005/000025

§ 371 (c)(1),
(2), (4) Date: Jun. 12, 2007

(87) PCT Pub. No.: WO2005/081263

PCT Pub. Date: Sep. 1, 2005

(65) Prior Publication Data

US 2008/0023645 A1 Jan. 31, 2008

(30) Foreign Application Priority Data

Feb. 20, 2004 (EP) ..... 04447049

(51) Int. Cl.
*G21K 5/08* (2006.01)

(52) U.S. Cl. ..... 250/433; 250/428; 250/429; 250/432 R; 250/493.1; 250/496.1; 376/156; 376/194; 376/195; 376/245

(58) Field of Classification Search ..... 250/432 R, 250/492.1, 493.1, 496.1, 428, 429, 433; 376/190, 376/194, 195, 245, 156
See application file for complete search history.

(56) References Cited

U.S. PATENT DOCUMENTS

| | | | | |
|---|---|---|---|---|
| 2,868,987 | A | 1/1959 | Salsig, Jr. et al. | |
| 3,349,001 | A | 10/1967 | Stanton | |
| 4,088,532 | A * | 5/1978 | Blue | 376/198 |
| 4,752,432 | A * | 6/1988 | Bida et al. | 376/195 |
| 4,800,060 | A * | 1/1989 | Goldring | 376/202 |
| 4,945,251 | A * | 7/1990 | Bechtold et al. | 250/492.1 |
| 5,425,063 | A * | 6/1995 | Ferrieri et al. | 376/195 |
| 5,586,153 | A * | 12/1996 | Alvord | 376/196 |
| 5,917,874 | A * | 6/1999 | Schlyer et al. | 376/194 |
| 6,359,952 | B1 * | 3/2002 | Alvord | 376/202 |
| 6,483,118 | B2 * | 11/2002 | Fujiwara et al. | 250/423 R |

(Continued)

FOREIGN PATENT DOCUMENTS

BE 1011263 6/1999

(Continued)

OTHER PUBLICATIONS

Zeisler et al., "A water-cooled spherical niobium target for the production of [18F]fluoride", Applied Radiation and Isotopes 53 (2000) 449-453.*

(Continued)

*Primary Examiner* — Michael Logie
(74) *Attorney, Agent, or Firm* — Fitch, Even, Tabin & Flannery, LLP

(57) ABSTRACT

The present invention is related to an irradiation cell for producing a radioisotope of interest through the irradiation of a target material by a particle beam, comprising a metallic insert forming a cavity designed to house the target material and to be closed by an irradiation window, wherein said metallic insert comprises at least two separate metallic parts of different materials, being composed of at least a first part comprising said cavity.

35 Claims, 4 Drawing Sheets

U.S. PATENT DOCUMENTS

| | | | | |
|---|---|---|---|---|
| 6,567,492 | B2 | 5/2003 | Kiselev et al. | |
| 6,586,747 | B1 * | 7/2003 | Erdman | 250/432 R |
| 6,917,044 | B2 * | 7/2005 | Amini | 250/492.1 |
| 7,200,198 | B2 | 4/2007 | Wieland et al. | |
| 7,831,009 | B2 * | 11/2010 | Alvord et al. | 376/195 |
| 2001/0040223 | A1 * | 11/2001 | Fujiwara et al. | 250/493.1 |
| 2004/0000637 | A1 * | 1/2004 | Wieland | 250/284 |
| 2004/0100214 | A1 * | 5/2004 | Erdman | 315/500 |
| 2005/0061994 | A1 * | 3/2005 | Amini | 250/492.1 |
| 2005/0084055 | A1 * | 4/2005 | Alvord et al. | 376/194 |
| 2005/0201504 | A1 * | 9/2005 | Zeisler et al. | 376/156 |
| 2006/0104401 | A1 * | 5/2006 | Jongen et al. | 376/190 |

FOREIGN PATENT DOCUMENTS

| | | | |
|---|---|---|---|
| BE | 1011263 | A6 * | 6/1999 |
| JP | 53046598 | A | 4/1978 |
| JP | 9054196 | A | 2/1997 |
| WO | 02/101758 | A1 | 12/2002 |
| WO | 02101757 | A2 | 12/2002 |
| WO | 02101757 | A3 | 12/2002 |

OTHER PUBLICATIONS

Buckley et al., "Improved yields for the in situ production of [11C]CH4 using a niobium target chamber", Nuclear Medicine and Biology 31 (2004) 825-827.*

Kilbourn et al., "A Simple 16O Target for 18F Production", Int. J. Appl. Radiat. Inst. vol. 35, No. 7, pp. 559-602, 1984.

Shaeffer et al., "Design of a 18F Production System At ORNL 86-Inch Cyclotron," ORNL/MIT-25810/19/77, pp. 1-16.

Wieland, "Foil Sealing Assembly used on 11 MeV Proton Targets," Proceedings of the First Workshop on Targetry and Target Chemistry, Heidelberg, West Germany, Oct. 4-7, 1985, pp. 14-16.

Wieland et al, "Current Status of CTI Target Systems for the Producation of Pet Radiochemicals" Proceedings of the Third Workshop on Targetry and Target Chemistry, Jun. 19-23, 1989, pp. 34-48.

Morelle et al., "An Efficient [18F] Fluoride Production Method Using a Recirculation 18O Water Target" Proceedings of the Third Workshop on Targetry and Target Chemistry, Jun. 19-23, 1989, pp. 50-51.

Link et al., "Irradiation of Water to Improve the Specific Activity of Oxygen-15 Produced from Oxygen-16", IVth International Workshop on Targetry and Target Switzerland, 1991, pp. 148-150.

Lindner et al., "Accelerator Production of 18F, 123Xe (123I), 211At and 38S", IAEA-SM-171/63, 1973, pp. 303-316.

International Search Report, International Application No. PCT/BE2005/000025, completed on Jan. 25, 2006, 5 pages.

International Search Report, International Application No. PCT/BE2003/000217, completed on Mar. 30, 2004, 5 pages.

* cited by examiner

TARGET DEVICE FOR PRODUCING A RADIOISOTOPE

FIELD OF THE INVENTION

The present invention relates to a device used as a target for producing a radioisotope, such as $^{18}F$, by irradiating with a beam of particles a target material that includes a precursor of said radioisotope.

One of the applications of the present invention relates to nuclear medicine, and in particular to positron emission tomography.

TECHNOLOGICAL BACKGROUND AND PRIOR ART

Positron emission tomography (PET) is a precise and non-invasive medical imaging technique. In practice, a radiopharmaceutical molecule labelled by a positron-emitting radioisotope, in situ disintegration of which results in the emission of gamma rays, is injected into the organism of a patient. These gamma rays are detected and analysed by an imaging device in order to reconstruct in three dimensions the biodistribution of the injected radioisotope and to obtain its tissue concentration.

Fluorine 18 ($T_{1/2}$=109.6 min) is the only one of the four light positron-emitting radioisotopes of interest ($^{11}C$, $^{13}N$, $^{15}O$, $^{18}F$) that has a half-life long enough to allow use outside its site of production.

Among the many radiopharmaceuticals synthesised from the radioisotope of interest, namely fluorine 18, 2-[$^{18}F$] fluoro-2-deoxy-D-glucose (FDG) is the radio-tracer used most often in positron-emission tomography. In addition to the morphology imaging, PET performed with 18F-FDG allows to determine the glucose metabolism of tumours (oncology), myocardium (cardiology) and brain (psychology).

The $^{18}F$ radioisotope in its anionic form ($^{18}F^-$) is produced by bombarding a target material, which in the present case consists of $^{18}O$-enriched water ($H_2{}^{18}O$), with a beam of charged particles, more particularly protons.

To produce said radioisotope, it is common practice to use a device constituting an irradiation cell comprising a cavity "hollowed out" in a metal part and intended to house the target material used as precursor. This metal part is usually called an insert.

The cavity in which the target material is placed is sealed by a window, called "irradiation window" which is transparent to the particles of the irradiation beam. Through the interaction of said particles with the said target material, a nuclear reaction occurs which leads to the production of the radioisotope of interest.

The beam of particles is advantageously accelerated by an accelerator such as a cyclotron.

Because of an ever increasing demand for radioisotopes, and in particular for the $^{18}F$ radioisotope, efforts are made to increase the yield of the above mentioned nuclear reaction. This is done either by modifying the energy of the beam of particles (protons), making use of the dependence of thick target yield on the particle energy, or by modifying the intensity of the beam, thereby modifying the number of accelerated particles striking the target material.

However, the power dissipated by the target material irradiated by the accelerated particle beam limits the intensity and/or the energy of the particle beam that is being used. This is because the power dissipated by a target material is determined by the energy and the intensity of the particle beam through the following equation:

$$P\ (\text{watts}) = E\ (\text{MeV}) \times I(\mu\text{A})$$

where:

P=power expressed in watts;

E=energy of the beam expressed in MeV; and

I=intensity of the beam expressed in μA.

In other words, the higher the intensity and/or the energy of the particle beam, the higher will be the power to be dissipated by a target material.

It will consequently be understood that the energy and/or the intensity of the beam of accelerated charged particles cannot be increased without rapidly generating, within the cavity of the production device, and at the irradiation window, excessive pressures or temperatures liable to damage said window.

Moreover, in the case of $^{18}F$ radioisotope production, given the particularly high cost of $^{18}O$-enriched water, only a small volume of this target material, used as a precursor material, at the very most a few milliliters, is placed in the cavity. Thus, the problem of dissipating the heat produced by the irradiation of the target material over such a small volume constitutes a major problem to be overcome. Typically, the power to be dissipated for a 18 MeV proton beam with an intensity of 50 to 150 μA is between 900 W and 2700 W, and this in a volume of $^{18}O$-enriched water of 0.2 to 5 ml, and for irradiation times possibly ranging from a few minutes to a few hours.

More generally, given this problem of heat dissipation by the target material, the irradiation intensities for producing radioisotopes are currently limited to 40 μA for an irradiated target material volume of 2 ml in a silver insert. Current cyclotrons used in nuclear medicine are however theoretically capable of accelerating proton beams with intensities ranging from 80 to 100 μA, or even higher. The possibilities afforded by current cyclotrons are therefore under-exploited.

Solutions have been proposed in the prior art for overcoming the problem of heat dissipation by the target material in the cavity within the radioisotope production device. In particular, it has been proposed to provide means for cooling the target material.

Accordingly, document BE-A-1011263 discloses an irradiation cell comprising an insert made of Ag or Ti, said insert comprising a hollowed-out cavity sealed by a window, in which cavity the target material is placed. The insert is placed in co-operation with a 'diffusor' element which surrounds the outer wall of said cavity so as to form a double-walled jacket allowing the circulation of a refrigerant for cooling said target material. For improving heat flow out of the cavity, a cavity having a wall as thin as possible is desirable. However, when silver is used as material for the cavity, wall porosity becomes a problem when wall thickness is smaller than 1.5 mm.

The materials for manufacturing the device according to the present invention have to be selected in a cautious way. In particular, the choice of the insert material is particularly important. It is indeed necessary to avoid the production of undesirable by-products during irradiation which would lead to a remaining activity. By way of example, it is necessary to avoid the production of such radioisotopes that disintegrate by high-energy gamma particle emission and make any mechanical intervention on the target difficult due to radiosafety problems. Indeed, the overall activity of the insert measured after irradiation and total emptying of said insert has to be as low as possible. Titanium is chemically inert but under proton irradiation produces $^{48}V$ having a half-life of 16 days. Consequently, in the case of titanium, should a target window break, its replacement would pose serious problems for the maintenance engineers who would be exposed to the ionizing radiation.

In addition, when choosing the type of material for the inserts of the device according to the invention, another key parameter is its thermal conductivity. Thus, silver is a good conductor but does have the drawback that, after several irradiation operations, it forms silver compounds that can block the emptying system.

It would be ideal to use niobium for the insert, this material having a thermal conductivity two and a half times higher than titanium (53.7 W/m/K for Nb and 21.9 W/m/K for Ti), though eight times lower than silver (429 W/m/K). Niobium is chemically inert and produces few isotopes of long half-life. Therefore, niobium is a good compromise. However, niobium is a difficult material to use in an insert of complex design, as it is difficult to machine. A built-up edge may occur on the tools, leading to high tool wear. Eventually, the tool may break. The use of electrical discharge machining is not a solution either: the electrodes wear out without shaping the piece to be machined. In particular, the insert described in document BE-A-1011263 is of a complex structure, which would be difficult to produce in niobium.

Also, using prior art insert forms and materials, it is impossible to produce a more elongated insert, which would be beneficial as it would provide a larger surface for the thermal exchange.

Tantalum is also a material having interesting properties, but, which is, like niobium, difficult to machine. Tantalum has a thermal conductivity (57.5 W/m/K) slightly higher (better) than Niobium.

Document WO02101757 is related to an apparatus for producing 18F-Fluoride, wherein an elongated chamber is present, for containing the gaseous or liquid target material which is to be irradiated. The chamber can be made from niobium. However, this apparatus does not comprise what is defined as an 'insert', a separate part comprising the cavity, which is to be introduced in the irradiation cell. The apparatus of WO02101757 comprises several parts assembled together, but there is no distinction between the cell and the insert. The same is true for the irradiation devices described in U.S. Pat. No. 5,917,874, US2001/0040223 and U.S. Pat. No. 5,425,063.

AIMS OF THE INVENTION

The closest prior art is therefore the BE1011263-patent. The invention aims to provide a better solution for irradiation devices of the type described in that document, namely devices comprising an irradition cell, and an insert as defined above.

A particular aim of the present invention is to provide an irradiation cell having an insert made at least partially of niobium or tantalum and designed in order to provide internal cooling means.

SUMMARY OF THE INVENTION

The present invention is related to an irradiation cell and insert such as described in the appended claims.

SHORT DESCRIPTION OF THE DRAWINGS

DETAILED DESCRIPTION OF A PREFERRED EMBODIMENT OF THE PRESENT INVENTION

The invention is related to an irradiation cell, for the purpose of containing, inside a cavity, the material to be irradiated for producing radioisotopes. The cell comprises internal cooling means for cooling the cavity, and a metallic insert comprising the cavity. The inventive aspect of the cell is that the insert is made of at least two parts, assembled together, and made of different materials. The part which comprises the cavity is designed in such a way that it is easy to produce in any material, so that it can be produced for instance in niobium, or in tantalum, which are the most suitable materials for irradiation purposes. The other part or parts of the insert can then be produced in another material. The invention is equally related to the metallic insert per se.

Figure 1:
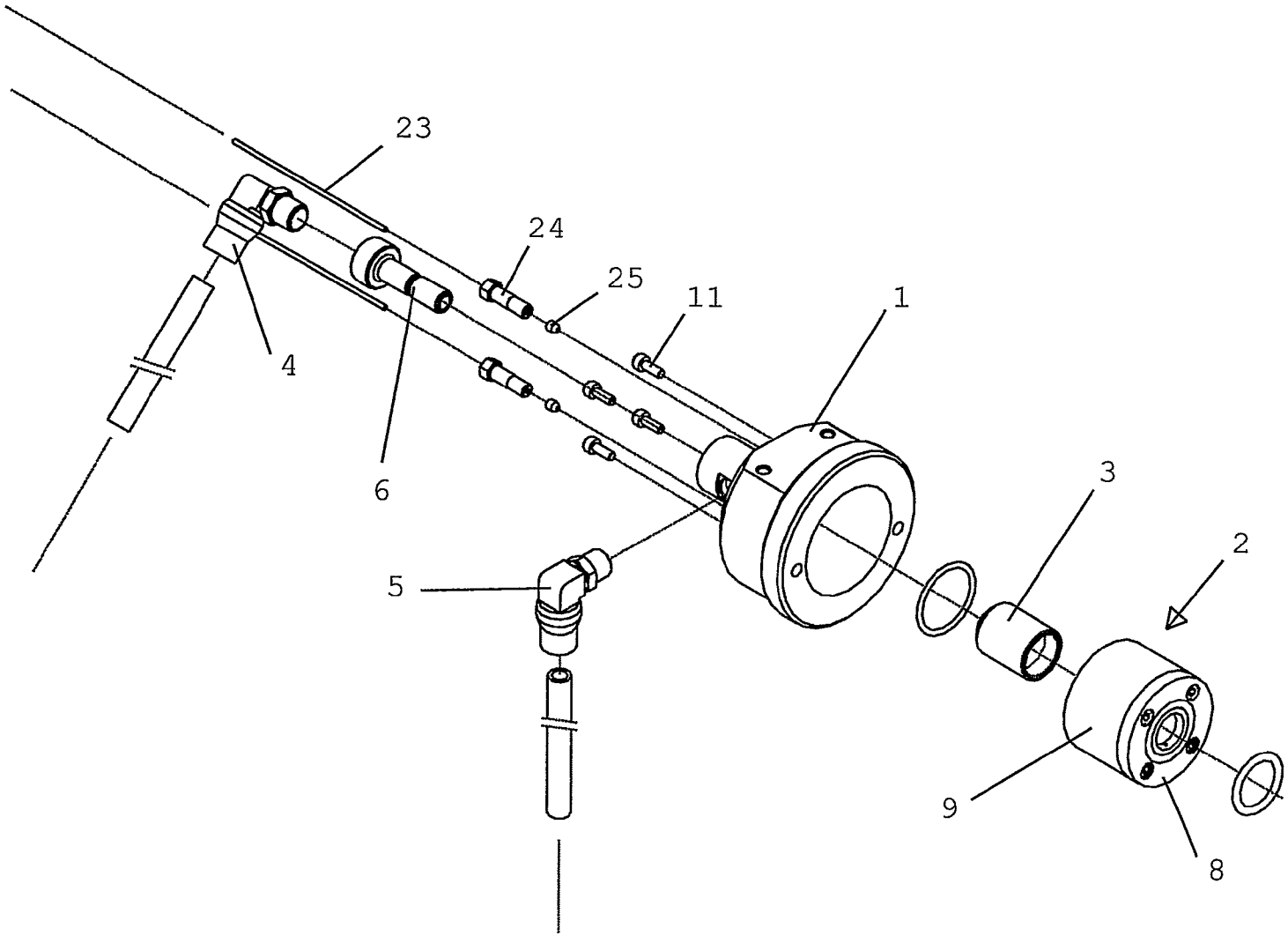
FIG. 1 is a 3-d view of the parts of an irradiation cell according to the present invention.

A preferred embodiment of the irradiation cell 1 is disclosed in the accompanying drawings. FIG. 1 is a 3-d view of the irradiation cell assembly, including the connections for the cooling medium. The irradiation cell comprises the target body 1 and the insert 2. The target body is coupled to a cooling medium inlet 4 and an outlet 5.

Figure 2:
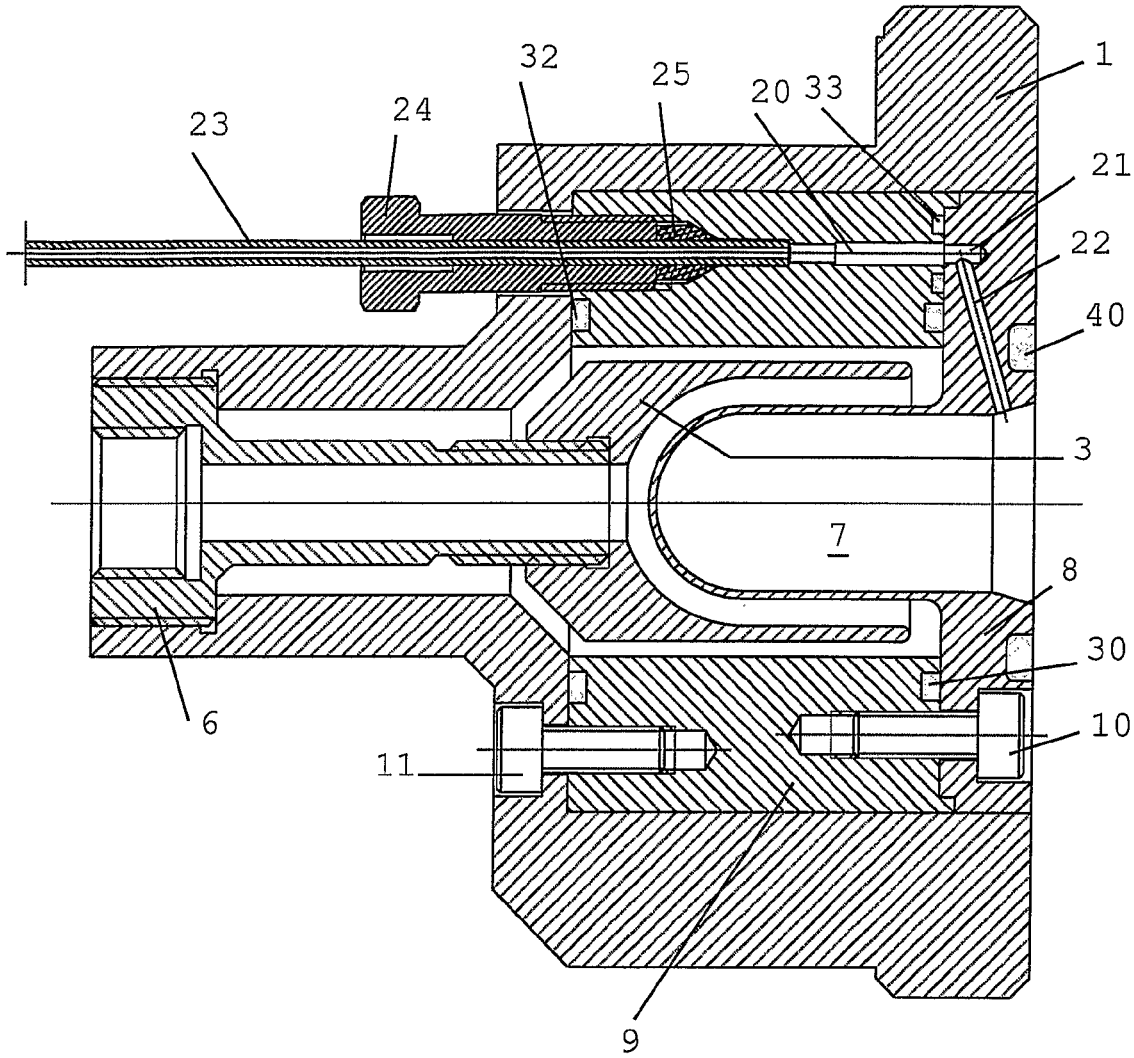
FIG. 2 is section view of an assembled device according to the invention.

The assembled irradiation cell can be seen in FIG. 2, where once more the target body 1 is visible. The insert 2 comprises a first metallic part 8 which comprises the cavity 7, wherein the target material is to be placed. The insert equally comprises a second metallic part 9 which surrounds the cavity 7, so as to form a channel for guiding a cooling medium around the cavity.

A means for supplying a cooling medium is present in the form of a tube 6, which is to be connected to the cooling inlet. At the end of this tube, a 'diffusor' element 3 is mounted which is essentially an element which is in connection with the supply tube, and arranged to surround the cavity in a manner to form a return path for said cooling medium between said diffusor and said second part.

According to the preferred embodiment of the present invention, the insert 2 is thus made of two metallic parts 8 and 9, assembled together by bolts 10. Real metal to metal contact and the presence of O-ring 30 and 32 provides an essentially perfect seal between the two parts 8 and 9, and between part 9 and target body 1, respectively, thereby preventing the escape of cooling water outside the irradiation cell. The first part 8 comprises the cavity 7. Because of its simple structure, this part 8 is easy to produce, meaning that it can be produced from the most suitable material for irradiation purposes, in particular niobium. The second metallic part 9 is itself bolted to the target body 1 by bolts 11. Because this second part is not in direct contact with the target material, it can be produced in another material, such as stainless steel or any conventional material. Being made of two parts, the insert of the invention allows the cavity-wall to be produced in the ideal material, niobium or tantalum, without encountering the practical problem of producing a complicated niobium or tantalum structure. Also, this design would allow to produce an insert with a more elongated cavity 7 in niobium or tantalum, than would be possible in existing inserts. In particular, a cavity with a length of up to 40 mm can be produced in an insert according to the invention.

The cavity 7 is closed (sealed) by an irradiation window transparent to the accelerated particle beam. The window is not shown on FIG. 2. It is placed against the structure shown, and sealed off by the O-ring 40. The window is advantageously made of Havar and between 25 and 200 μm thick, preferably between 50 and 75 μm thick.

Figure 3:
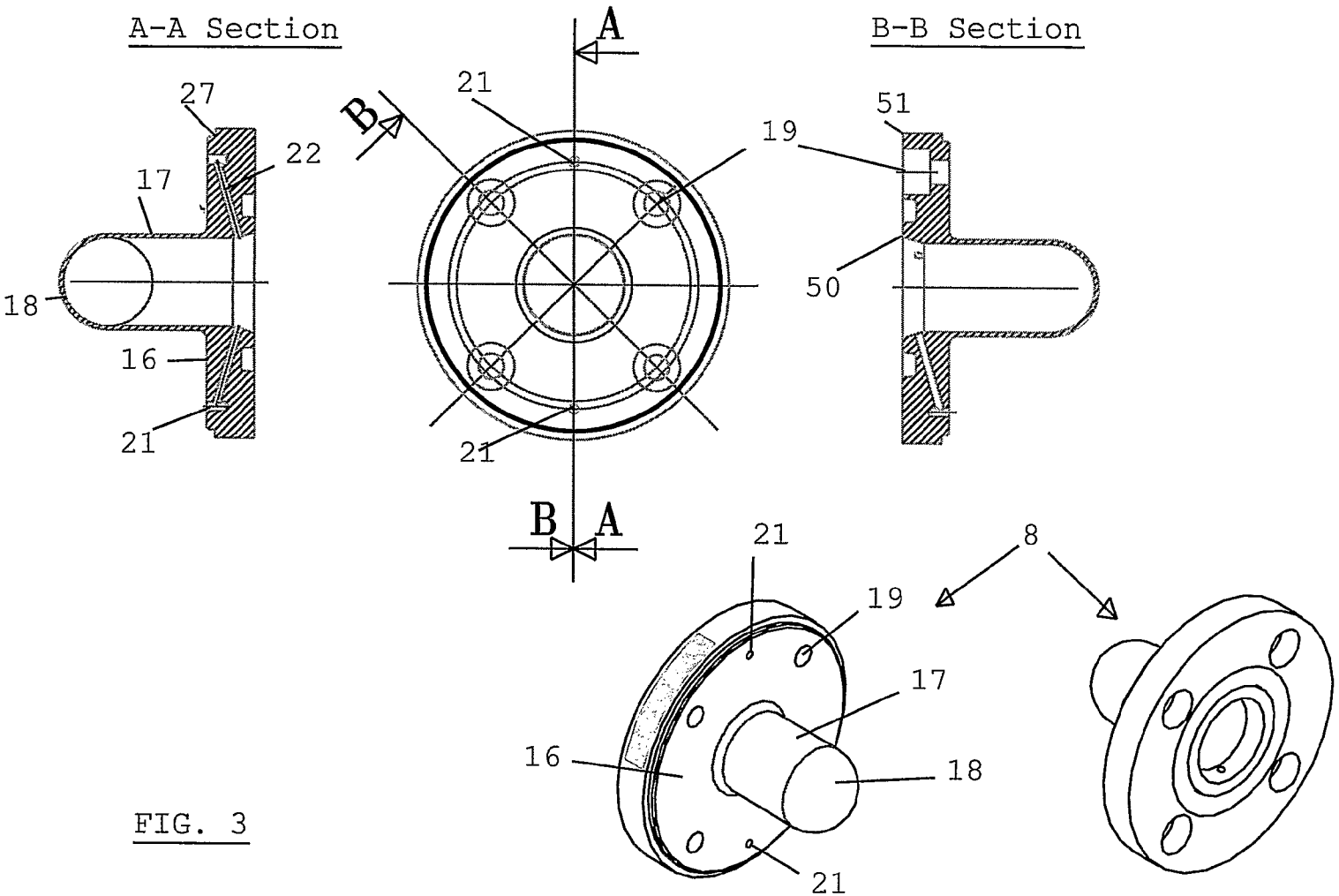
FIG. 3 shows a right section view, rear view, left section view, and perspective views of one of the parts of the irradiation cell.
Figure 4:
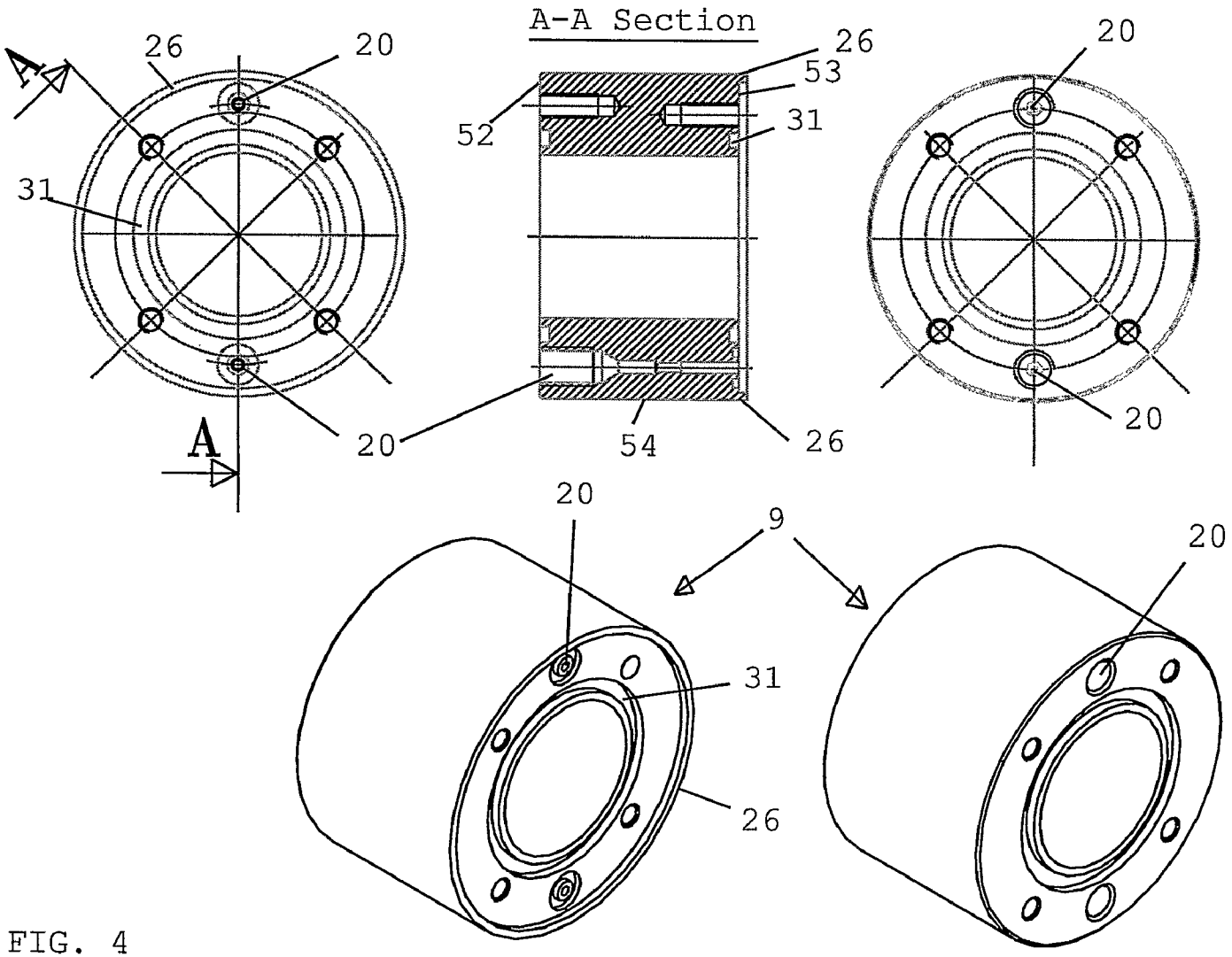
FIG. 4 shows a front view, section view, back view and perspective views of another of the consisting parts of the irradiation cell.

FIG. 3 shows section and perspective views of the first part 8 according to the preferred embodiment. FIG. 4 shows the same for the second part 9. The part 8 essentially comprises a flat, ring shaped circular portion 16, having an inner and outer circular edge (50,51 respectively). A cylindrical portion 17 rises up perpendicularly from the inner edge of the flat portion 16, with a hemispherical portion 18 on top of the cylindrical portion 17, closing off the cavity from that side. A cavity having an inner diameter of 11.5 mm, and an overall length of 25 mm, produces a 2 ml volume for containing the target material. The length of the cavity may be adapted according to the desired volume. A larger outer surface allows a better thermal exchange between the target material in the cavity and cooling means, at the cost of more target material. Using the two-part design of the invention, cavities having a first part 8 with an overall length of 50 mm or even higher can be produced, even when it is difficult to machine materials such as niobium and tantalum. Holes 19 are present in the flat portion, to bolt the first part 8 to the second part 9. Niobium and tantalum having a lower thermal conductivity than silver inserts, it is desirable to have the cylindrical 17 and hemispherical 18 portions as thin as possible, in order to improve the thermal exchange between target material in cavity 7 and cooling water. A thickness of 0.5 mm has been found acceptable to obtain the required heat exchange, without suffering from porosity problems. It has been found by the inventors of the present invention that obtaining such a thin wall, especially for an insert having a great length, is only obtainable with a two-part insert. It has also been found by the inventors that the irradiation cell according to the invention produces a high yield in the radioisotope of interest, even when the cavity is only partially filled with the target material before irradiation start. Satisfactory yields are obtained when filling ratio, i.e. ratio of target material volume inserted in cavity over cavity internal volume are below 50%, preferably about 50%. This is different than prior art devices, in particular the one shown in BE10112636. Using the insert of that document, the cavity is necessarily shorter due to the machining difficulty described above. A consequence of this is that these short cavities need to be filled to a maximum, otherwise too much of the radiation energy is lost. If one is able to use a longer cavity, this is beneficial for the heat exchange, as already stated, but another consequence is that a good irradiation efficiency can be obtained even with a filling rate of about 50%. This is because a half-filled long cavity allows for more space to be filled with vapour after irradiation has started, and a longer distance over which this vapour can react with the proton beam. Therefore, the 50% filling rate is directly related to the longer cavity and thus to the two-part construction of the insert.

As seen in FIG. 4, part 9 is essentially a hollow cylinder, comprising two flat sides 52, 53 essentially perpendicular to a cylindrical circumferential side 54. The part 9 comprises holes for bolting it at one flat side 53 against the first part 8 and by the other flat side 52 to the target body 1. The flat side 53 which is to be put against the first part 8, is equipped with a protruding ridge 26, which is to fit into a groove 27 around the circumference of the first part 8. This allows a perfect coaxial positioning of parts 8 and 9 with respect to each other.

Other shapes of parts 8 and 9 or additional sub-parts of the insert may be devised according to the invention which is related to the broader concept of an insert made of more than one solid part made of different materials.

In the preferred embodiments shown, the part 9 has two diametrically opposed openings 20, which correspond, when the insert is assembled, to two holes 21 in the first part 8. These holes 21 give access to two tubes 22 in the interior of the part 8, which lead up to the cavity 7. On the assembled irradiation cell, external tubes 23 can be mounted by hollow bolts 24, through seals 25, for connection to the openings 20 and tubes 22. The two tubes 23 can then be coupled to a circuit for circulating fluid material to be irradiated in the cell, or for filling the cell before irradiation and emptying the cell after irradiation.

Furthermore, cooling means using liquid helium may be provided to cool the irradiation window.

Further in the preferred embodiment shown in the accompanying drawings, the sealing between parts 8 and 9 is obtained by an O-ring 30 accommodated in a circular groove 31 in the second part 9. Another O-ring 32 seals off the connection between the second part 9 and the target body 1. Further O-rings 33 are present in grooves surrounding the outlets 20 of the tubes 23 for filling and emptying the irradiation cell 7, thereby preventing the escape of target material outside of the cavity 7. These O-rings are especially important because they may come in contact with the target material which may comprise chemically or nuclear active material, and must withstand the pressure inside the cavity 7 during irradiation. This pressure may be up to 35 bar or higher. The material for the O-rings is preferably Viton.

Due to the metal-to-metal contact, the insert of the invention is designed so that there is virtually no contact between the target material ($^{18}$O-enriched water) and the O-rings. No chemical contamination coming from Viton degradation is possible in this design.

According to an alternative embodiment, there are no O-rings between the parts 8 and 9 of the insert, but a gold foil is inserted between said parts. This foil ensures the perfect seal for the target material inside the cavity.

In yet another embodiment, the connection between parts 8 and 9 is not obtained by bolts, but by welding.

By selecting an appropriate material for the first part (8) of the insert, such as niobium or tantalum which have a very low chemical reactivity with the chemicals present in the cavity 7, especially with $^{18}$F-, one obtains a virtually permanent hard-wearing target. In addition, by using such inert material, no products that could clog the tubes in which the target material flows are dissolved into the target material.

The invention claimed is:

1. An irradiation cell for producing a radioisotope of interest through the irradiation of a target material by a particle beam, the irradiation cell comprising a target body, a diffuser configured to provide a path for a cooling medium, and a removable metallic insert comprising a cavity designed to house the target material and the cavity closed by an irradiation window, the metallic insert configured to be inserted in and removed from the target body, wherein the removable metallic insert comprises at least two separate metallic parts of different materials, the metallic insert comprising at least a first part and a second part, the first part having a wall with a thickness between 0.3 and 0.7 mm and an elongated cavity surrounded by the wall, the cavity being longer in a direction parallel to the particle beam that irradiates the target than in a direction perpendicular to the particle beam, and the second part partially surrounding the first part and forming a channel configured to guide a cooling medium, the first part being removable from the irradiation cell without removal of the second part by sliding the first part in a direction parallel to the particle beam.

2. The irradiation cell according to claim 1, wherein said cell further comprises a coolant supply configured to supply the cooling medium and the coolant supply in connection with the channel the diffuser device surrounding the first part and being configured to guide the cooling medium around the first part, and wherein the second part surrounds both the first part and the diffuser device in a manner to form a return path for the cooling medium between the diffuser device and the second part.

3. The irradiation cell according to claim 1, wherein the contact between the first and second part is a metal-to-metal contact, and wherein the parts are sealed by at least one O-ring.

4. The irradiation cell according to claim 1, wherein the first and second parts are sealed by a gold foil between the parts.

5. The irradiation cell according to claim 1, wherein the first and second parts are assembled together by a number of bolts.

6. The irradiation cell according to claim 1, wherein the first and second parts are assembled together by welding.

7. The irradiation cell according to claim 1, wherein the first part comprises a flat, circular and ring-shaped portion having an inner circular edge and an outer circular edge, a cylindrical portion rising perpendicularly from the inner circular edge of the flat portion, and a hemispherical portion being on top of the cylindrical portion, the cavity being formed inside the cylindrical and hemispherical portions.

8. The irradiation cell according to claim 7, wherein the cavity has a length of at least 50 mm.

9. The irradiation cell according to claim 7, wherein the second part has the form of a hollow cylinder having two flat sides essentially perpendicular to a cylindrical side, the cylinder being connected by one flat side against the flat portion of the first part.

10. The irradiation cell according to claim 7, wherein one of the two parts has a ridge and the other has a groove corresponding to the ridge, in order to obtain perfect coaxial positioning of the two parts with respect to each other.

11. The irradiation cell according to claim 1, wherein the first part is made of niobium or tantalum.

12. The irradiation cell according to claim 1, wherein the second part is made of stainless steel.

13. A method for filling the cavity volume of the irradiation cell according to claim 1 with about 50% of target material before starting irradiation.

14. The irradiation cell according to claim 1, wherein the cell further comprises a supply tube for a cooling medium and, in connection with the supply tube, a diffuser device mounted on one end of the supply tube, the diffuser device surrounding the first part, the diffuser element being configured to guide the cooling medium around the first part, and wherein the second part surrounds both the first part and the diffuser element in a manner to form a return path for the cooling medium between the diffuser element and the second part.

15. An irradiation cell for producing a radioisotope of interest through the irradiation of a target material by a particle beam, the irradiation cell comprising a target body, a diffuser for providing a path for a cooling medium, and a removable metallic insert comprising a cavity designed to house the target material, the cavity closed by an irradiation window, the metallic insert configured to be inserted in and removed from the target body, wherein the removable metallic insert comprises at least two separate metallic parts of different materials, the metallic insert comprising at least a first part and a second part, the first part having a cylindrical portion and a hemispherical portion and machined from a material selected from the group consisting of niobium and tantalum and forming a cavity that is elongate in a direction parallel to the particle beam that irradiates the target, and the second part being a generally cylindrical hollow member disposed concentrically about the first part and comprising a material selected from the group consisting of stainless steel, silver, and titanium, with the second part disposed around at least a portion of the elongate cavity of the first part and the first and second parts forming a channel configured to guide a cooling medium, the first part removable from the irradiation cell without removal of the second part by sliding the first part in a direction parallel to the particle beam.

16. The irradiation cell according to claim 15, wherein said cell further comprises a coolant supply configured to supply the cooling medium and the coolant supply in connection with the channel the diffuser device surrounding the first part and being configured to guide the cooling medium around the first part, and wherein the second part surrounds both the first part and the diffuser device in a manner to form a return path for the cooling medium between the diffuser device and the second part.

17. The irradiation cell according to claim 15, wherein the contact between the first and second part is a metal-to-metal contact, and wherein the parts are sealed by at least one O-ring.

18. The irradiation cell according to claim 15, wherein the first and second parts are sealed by a gold foil between the parts.

19. The irradiation cell according to claim 15, wherein the first and second parts are assembled together by a number of bolts.

20. The irradiation cell according to claim 15, wherein the first and second parts are assembled together by welding.

21. The irradiation cell according to claim 15, wherein the first part comprises a flat, circular and ring-shaped portion having an inner circular edge and an outer circular edge, a cylindrical portion rising perpendicularly from the inner circular edge of the flat portion, and a hemispherical portion being on top of the cylindrical portion, the cavity being formed inside the cylindrical and hemispherical portions.

22. The irradiation cell according to claim 21, wherein the cylindrical portion and/or the hemispherical portion have a wall thickness comprised between 0.3 and 0.7 mm.

23. The irradiation cell according to claim 21, wherein the second part has the form of a hollow cylinder having two flat sides essentially perpendicular to a cylindrical side, the cylinder being connected by one flat side against the flat portion of the first part.

24. The irradiation cell according to claim 21, wherein one of the two parts has a ridge and the other has a groove corresponding to the ridge, in order to obtain perfect coaxial positioning of the two parts with respect to each other.

25. An irradiation cell for producing a radioisotope of interest through the irradiation of a target material by a particle beam, the irradiation cell comprising a target body, a removable metallic insert comprising a cavity designed to house the target material, the cavity closed by an irradiation window and the metallic insert configured to be inserted in and removed from the target body, wherein the removable metallic insert comprises at least two separate metallic parts of different materials, the metallic insert comprising at least a first part and a second part, the first part having an elongated cavity that is longer in a direction parallel to the particle beam that irradiates the target than in a direction perpendicular to the particle beam, and the second part partially surrounding the first part and forming a channel configured to guide a cooling medium in a direction parallel to the direction of the beam and perpendicular to the direction of the beam so that the cooling medium surrounds the cavity, the first part being removable from the irradiation cell without removal of the second part by sliding the first part in a direction parallel to the particle beam.

26. The irradiation cell according to claim 25, wherein said cell further comprises a coolant supply configured to supply the cooling medium with the coolant supply in connection with the channel, a diffuser device surrounding the first part, the diffuser device being configured to guide the cooling medium around the first part, and wherein the second part surrounds both the first part and the diffuser device in a manner to form a return path for the cooling medium between the diffuser device and the second part.

27. The irradiation cell according to claim 25, wherein the contact between the first and second part is a metal-to-metal contact, and wherein the parts are sealed by at least one O-ring.

28. The irradiation cell according to claim 25, wherein the first and second parts are sealed by a gold foil between the parts.

29. The irradiation cell according to claim 25, wherein the first and second parts are assembled together by a number of bolts.

30. The irradiation cell according to claim 25, wherein the first and second parts are assembled together by welding.

31. The irradiation cell according to claim 25, wherein the first part comprises a flat, circular and ring-shaped portion having an inner circular edge and an outer circular edge, a cylindrical portion rising perpendicularly from the inner circular edge of the flat portion, and a hemispherical portion being on top of the cylindrical portion, the cavity being formed inside the cylindrical and hemispherical portions.

32. The irradiation cell according to claim 25, wherein the first part is made of niobium or tantalum.

33. The irradiation cell according to claim 25, wherein the second part is made of stainless steel.

34. The irradiation cell according to claim 25, wherein the cell further comprises a supply tube configured to supply a cooling medium and, in connection with the supply tube, a diffuser device mounted on one end of the supply tube, the diffuser device surrounding the first part, the diffuser element being configured to guide the cooling medium around the first part, and wherein the second part surrounds both the first part and the diffuser element in a manner to form a return path for the cooling medium between the diffuser element and the second part.

35. An irradiation cell for producing a radioisotope of interest through the irradiation of a target material by a particle beam, the irradiation cell comprising a target body, a removable metallic insert comprising a cavity designed to house the target material, the cavity closed by an irradiation window and the metallic insert configured to be inserted in and removed from the target body, wherein the removable metallic insert comprises at least two separate metallic parts of different materials, the metallic insert comprising at least a first part and a second part, the first part machined from a material selected from the group consisting of niobium and tantalum and forming a cavity surrounded by a wall having a thickness between 0.3 and 0.7 mm, the cavity being elongate in a direction parallel to the particle beam that irradiates the target, and the second part being a generally cylindrical hollow member comprising a material selected from the group consisting of stainless steel, silver, and titanium, the second part partially surrounding the first part and forming a channel configured to guide a cooling medium in a direction parallel to the direction of the beam and perpendicular to the direction of the beam so that the cooling medium surrounds the cavity, the first part removable from the irradiation cell without removal of the second part by sliding the first part in a direction parallel to the particle beam;

wherein the cell further comprises a supply tube configured to supply a cooling medium and, in connection with the supply tube, a diffuser device mounted on one end of the supply tube, the diffuser device surrounding the first part, the diffuser element being configured to guide the cooling medium around the first part, and wherein the second part surrounds both the first part and the diffuser element in a manner to form a return path for the cooling medium between the diffuser element and the second part.

* * * * *

UNITED STATES PATENT AND TRADEMARK OFFICE

CERTIFICATE OF CORRECTION

PATENT NO. : 8,288,736 B2
APPLICATION NO. : 10/597974
DATED : October 16, 2012
INVENTOR(S) : Amelia et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this
First Day of July, 2014

Michelle K. Lee

Michelle K. Lee
*Deputy Director of the United States Patent and Trademark Office*